US005566688A

United States Patent [19]

Nakamura

[11] Patent Number: 5,566,688

[45] Date of Patent: Oct. 22, 1996

[54] HAIR IRON FOR STRAIGHT-PERMING

[76] Inventor: Tetugi Nakamura, 3400-1 Tabeta Kawanabe-cho, Kawanabe-gun, Kagoshima-ken, Japan

[21] Appl. No.: 260,074

[22] Filed: Jun. 15, 1994

Related U.S. Application Data

[62] Division of Ser. No. 997,788, Dec. 29, 1992, Pat. No. 5,357,988.

[51] Int. Cl.[6] ..... A45D 7/02

[52] U.S. Cl. ..... 132/21.1

[58] Field of Search ..... 132/225, 211, 132/271; 219/225

[56] References Cited

U.S. PATENT DOCUMENTS 4,739,151 4/1988 Smal ..... 132/225

*Primary Examiner*—Todd E. Manahan
*Attorney, Agent, or Firm*—Koda and Androlia

[57] ABSTRACT

A hair iron is designed to be used in straight-perming hair, especially straight-perming frizzled hair. The hair iron comprises a grip part and pressing members. Opposing surfaces of the pressing member for clasping and pressing hair have uneven faces which match each other. The uneven faces may cover the entire opposing surfaces of the pressing members or parts of them. The uneven faces give relatively large pressure on hair. Repetition of pressing and releasing hair with shifting the iron on the hair from the root to the tip causes the hair to be pressed in multiple directions so as to be deformed into a tiny waveform. Combining regular treatment with perming lotion, the repetition, and sliding the hair iron frictionally on the hair from the root to tip to stretch the hair makes the hair straight tidily.

2 Claims, 6 Drawing Sheets

HAIR IRON FOR STRAIGHT-PERMING

This is a division of application Ser. No. 07/997,788, filed Dec. 29, 1992, now U.S. Pat. No. 5,357,988.

BACKGROUND OF THE INVENTION

1. Field of the Invention

The present invention relates to a hair iron for straight-perming hair, especially for straight-perming frizzled hair, at a barbershop, a beauty salon or the like.

2. Prior Art

As conventional hair irons, for example, an iron for pressing down standing hair and an iron for curling hair have been known. However, there is no art or tools for straightening frizzled hair tidily.

For straightening hair by cold perming, a method of straight perming by adhering hair to a straight panel has been known. In this method, frizzled hair is stretched and adhered to a panel and then treated with a perming lotion. However, the finish is hard to say neatly straight.

Hair is neither curled nor waved into the same shape of a rod or other tools to be used in perming, but the shape of the waved or curled hair is many times as moderate as the shape of the rod or tools. For example, if hair is rolled on a rod of 1 cm in diameter and permed in cold perming, the finish is not in the same shape as the rod of 1 cm in diameter, but about two to four times as moderate as the shape of the rod. There is a type of hair iron with which hair is permed after being treated with a chemical solution in the same manner as in conventional cold perming. Even if hair is permed with this type of hair iron and the rod member of the hair iron is 1 cm in diameter, the hair can not be formed into the same shape of the rod member, but has the curl which is two to four times as moderate as the shape of the rod member. Additionally, another type of hair iron for styling hairdos has been known and this hair iron has opposing wavy parts between which hair is clasped, but this is a hair iron only for styling hairdos, not for perming hair by the use of chemical solutions.

In the conventional art of straightening frizzled hair, close attention is always paid to 'stretching' frizzled hair. In the art of straight perm wherein hair is stretched, adhered to a straight flat panel and then treated with a perming lotion, hair is not permed into a form exactly according to the shape of the tool (the panel). That is, the hair is not straightened according to the shape of the flat panel.

Recently another type of hair iron has been brought into the market. This hair iron has a right-angled step in the opposing parts for clasping hair, at which frizzled hair is bent to be straightened. By the method using this type of iron, frizzled hair becomes to look straight as a whole, but bending hair at the corner damages hair and makes it rugged. Also if the temperature of the hair iron is too low, the hair is not bent at the corner and does not become to look straight, while if the temperature is too high, the hair is terribly damaged.

SUMMARY OF THE INVENTION

It is hence a primary object of the present invention to provide a hair iron which overcomes the above shortcomings and straighten hair tidily and satisfactorily.

The applicant has been engaged in the hairdressing business for many years, but there had been no reliable art or tools for straightening frizzled hair. Keeping trying to overcome the above problems, the applicant gave corrugation on opposing flat clasping faces of a conventional hair iron and permed hair with it, and noticed that this iron could give larger pressure on the hair. As a result, the present invention to be described below was made.

Different from conventional straight perming wherein hair is stretched and adhered to a straight flat plate, a hair iron of the present invention bends and presses hair in multiple directions to straighten it. The hair iron comprises uneven faces on both the confronting surfaces of the members between which hair is clasped and pressed (hereinafter referred to as pressing members), and the confronting uneven faces are shaped to match each other. A heater is provided at least on one of the opposing faces. But, it is preferable and more effective that both the faces of the pressing members have respective heaters.

The pressing members may have uneven faces either on the entire opposing faces or in part of them with a slight clearance between the parts other than uneven faces when the hair iron is closed.

In order to straight-perm hair with the hair iron of the present invention, firstly the hair iron is closed near the root portion of (frizzled) hair to clasp it between the pressing members, and drawn to frictionally slide on the hair from the root to the tip. As a result, although only temporarily, the hair becomes roughly straight. Then secondly the hair iron is closed tight again at the said root portion of the hair to clasp and press the hair by the pressing members, and subsequently opened. Slightly being shifted the clasping position toward the tip of the hair, the iron is closed down tight to clasp and press the hair again by the pressing members, and then opened. The iron is shifted little by little from the root to the tip of the hair.

While being treated in this way repeatedly, the hair is warmed, and is pressed vertically and laterally in multiple directions by the uneven faces of the pressing members. After having been pressed once, the hair is clasped and pressed again, but by a slightly shifted different position of the pressing portions, so the hair newly has another moderate shape than the pressing portions slightly keeping the previously pressed shape. Being likewise treated from the root to the tip, the hair becomes to have repetition of a more moderate shape than the shape of the pressing members on its entire length. Another round treatment from the root to tip may be given to the hair, if necessary. Repetition of the above step makes the hair deformed many times, and resulting in a fine waveform. Here, "fine" means that the wave is small both in wavelength and in wave width. And "wave width" denotes here the distance between the crest and the bottom of the wave. In the final step of using the hair iron, the hair is treated like in the first step, that it, the hair is clasped at the root and the iron slides down from there to the tip of the hair frictionally so that the hair may be stretched and have a waveform which is smaller in width and longer in length than before and becomes more straight.

In using the hair iron of the present invention, the iron is repeatedly closed and opened and shifted its position with respect to the hair little by little in the manner a clasped area overlaps the former clasped area. Therefore, once clasped and pressed portion of the hair is repeatedly clasped and pressed both vertically and laterally in multiple directions two, three, four and five times and more, so that the hair no longer bends in any direction, thereby becoming rather straight. (Here a hair has many tiny waves in fact, so it looks straight from a distance.

Being thus constituted, whether hair is frizzled or not, the hair iron of the present invention enables to apply wonderful tidy straight perm on hair without damaging it.

DETAILED DESCRIPTION OF THE INVENTION

Figure 1:
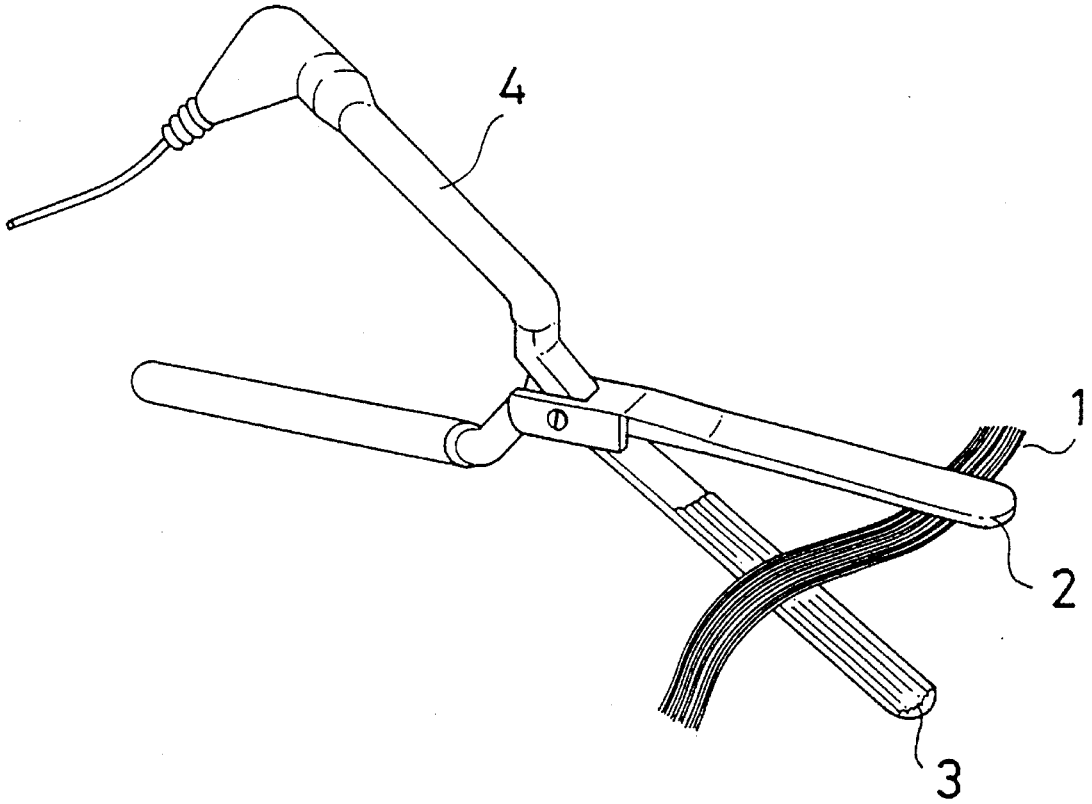
FIG. 1 is an overall perspective view of a hair iron in a first embodiment of the present invention.

Referring now to the drawings, some of the embodiments of the present invention are described below.

Figure 2:
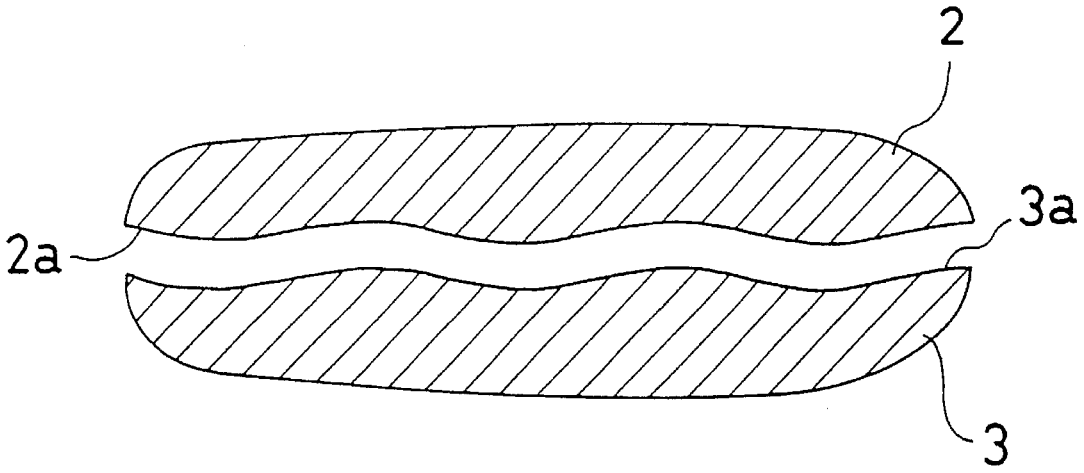
FIG. 2 is a partly magnified sectional view of the pressing members of the hair iron in FIG. 1.

A first embodiment of the present invention is illustrated in FIGS. 1 and 2. As clear from FIG. 1, a hair iron of the embodiment comprises a grip part 4 and pressing members 2, 3. The opposing surfaces 2*a*, 3*a* of the pressing members 2, 3, are corrugated and match each other as shown in FIG. 2. A strand of hair 1 is clasped by the corrugated surfaces 2*a*, 3*a* of the pressing members 2, 3, as shown in FIG. 1.

Explained below is a method of straight-perming frizzled hair.

In the first step, regular iron perming is applied to hair with using a conventional perming solution (the first solution). That is, hair is coated with the first perming solution, and then covered with a cap. By warming it for about 10 minutes in a warming promoter, or by letting it stand for about 15 to 20 minutes in a spontaneous state, the chemical solution is allowed to permeate into the hair. Next, the chemical solution is washed away from the hair by lukewarm water. After the water being wiped off with towel, the hair is further half dried by hair dryer. At this stage, it is desired to coat the hair with a protective agent (oil or cream) so that the hair may not be damaged by the heat of the hair iron.

Consequently, using the hair iron of the present invention, frizzled hair is deformed roughly straight. Since it is hard to use the hair iron on extremely frizzled hair, the following preliminary treatment is given. Namely, the hair iron is closed to clasp the root of a strand of hair between the sufficiently heated corrugated surfaces 2*a*, 3*a* of the pressing members 2, 3, and a comb is placed in the hair in front of the hair iron (at the tip side), and the hair iron and the comb are both pulled and slid slowly to the tip side.

Thus, the strand of frizzled hair is combed and warmed by the heat of the hair iron at the same time, so that the frizzled hair is stretched. At this step, the frizzled hair becomes temporarily and roughly straight. If the hair does not become straight enough at this point, the same may be repeated two or three times. Next, in order to deform the frizzled hair, the iron is closed to clasp and press a strand of hair at the root thereof between the corrugated faces 2*a*, 3*a* of the pressing members 2, 3, and then pulled toward the tip of the hair strand, but not to slide on the hair. At this point the corrugation of the opposing surfaces 2*a*, 3*a* of the pressing members 2, 3 applies relatively large pressure to the hair. Then, the iron is opened, shifted its position with respect to the hair slightly toward the tip side, closed down to clasp and press the hair, and pulled toward the tip side not to slide on the hair. These steps are given to the hair repeatedly with slightly shifting the iron from the root to the tip of the hair. During this process, part of the hair is pressed and deformed according to the shape of the corrugated faces 2*a*, 3*a*, but into the form which is more moderate than the shape of the corrugated faces 2*a*, 3*a*. And in the next step the part of the hair is pressed by the corrugated faces 2*a*, 3*a* again, but the positional relation between the two is slightly different from before. Therefore the part of the hair is again deformed into a slightly more moderate form than the shape of the corrugated faces 2*a*, 3*a*, but according to different part of the corrugated faces 2*a*, 3*a*, with slightly keeping the previous form. Namely a new form is overlaid upon the previous form. Repetition of this step (usually four or five times) causes the frizzled hair to be gradually deformed into a fine waveform. The number of repetitions of the step with the hair iron varies with the degree of curliness or frizziness of hair.

In the finishing stage of using the hair iron, the iron is closed to clasp the root of the hair between the corrugated faces 2*a*, 3*a* of the pressing members 2, 3 and drawn to slide on the hair slightly frictionally toward the tip of the hair. This stretches the hair to look straight as a whole although the hair still has a fine waveform.

Figure 5:
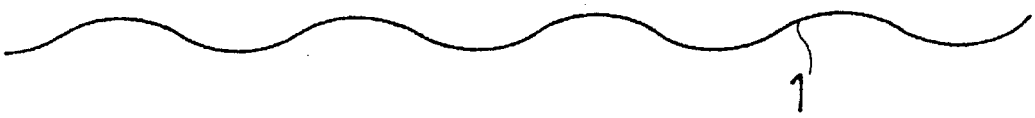
FIGS. 5(*a*) to 5(*h*) are explanatory diagrams showing stepwise changes of one hair treated by pressing with the hair iron of the present invention.
Figure 5:
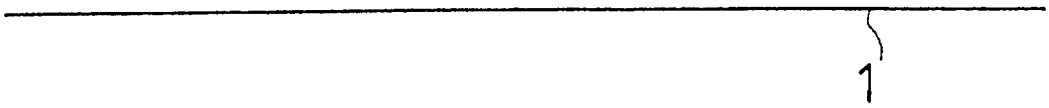
Figure 5:
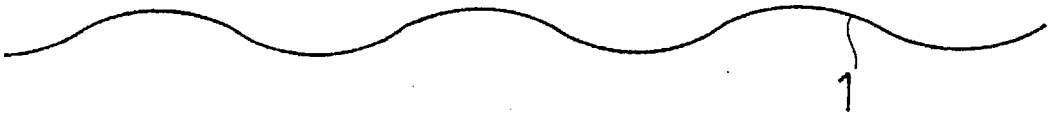
Figure 5:
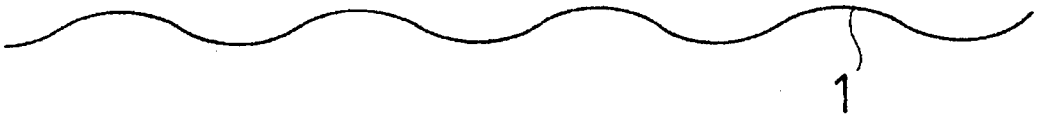
Figure 5:
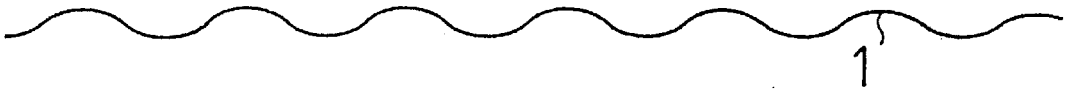
Figure 5:
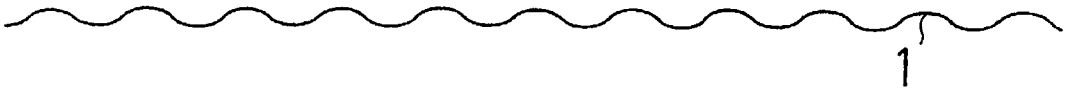
Figure 5:
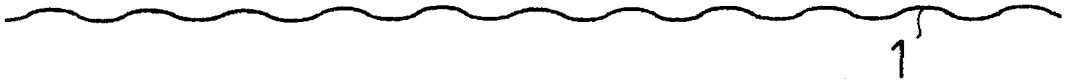
Figure 5:
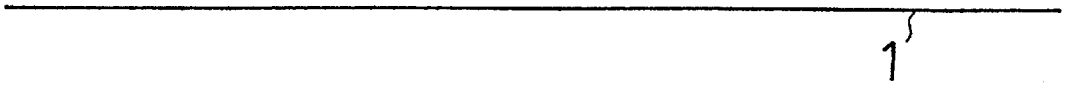

The set of FIGS. 5(*a*)–5(*h*) shows changes of the hair following the steps of the treatment described above. The hair in FIG. 5(*a*) is a frizzled hair before treatment. FIG. 5(*b*) shows the hair temporarily straightened by firstly sliding the hair iron on it. FIG. 5(*c*) to 5(*f*) show the hair gradually changing through the repetition of the above process. FIG. 5(*g*) illustrates the hair after finally sliding the hair iron on the hair from the root to the tip. Subsequently the hair is treated with perming lotion and dried as described below, and it becomes completely straight shown in FIG. 5(*h*).

In the final perming step after the treatment with the hair iron, the hair is treated regularly with a perming chemical solution (the second solution). The hair is coated with the second solution, washed off the solution by lukewarm water after being kept in a warming promoter for about 5 minutes or being let stand in a spontaneous state for about 10 minutes, and then dried by hair dryer. As a result, the hair becomes not only straight, but also flawless (to the naked eye), smooth and glossy.

For example, assuming that a hair iron whose corrugated faces 2*a*, 3*a* are 3 cm in width is used and shifted on the hair from the root to the tip by 1 cm each time. The iron is shifted by ⅓ of the width of the pressing members. So one round of the step from the root to the tip gives pressure on the same part of the hair three times.

A hair iron with wider corrugated faces may curtail the number of times of clasping hair and is preferable for perming long hair. On the other hand, it is easier to use a hair iron with narrower corrugated faces for short hair. Therefore, the width of the corrugated faces is not particularly limited, but may be preferably within the rage between 0.8 to 8 cm.

Incidentally, the shape of the corrugated faces 2*a*, 3*a* of the pressing members is desired to have the wave width of ⅕ to 1/30 of the wave length, and at least one wave (for example, from a crest to the next crest) is needed in the pressing members. If the wave width is too big compared with the wave length, pressing force is too strong and the wave profile remains on the finished hair. To the contrary, if the wave width is too small, pressing force is too weak to deform hair. It is hence necessary to choose a right hair iron having a proper corrugation depending on the quality of hair. In general, the wave width of about ⅐ of the wave length is suitable for stiff and thick frizzled hair, while that of less than 1/13 is preferable for fine and weak frizzled hair and that of less than 1/20 for originally straight hair. The flatter opposing faces of hair pressing members are formed, the weaker pressure the hair iron applied to hair. In the present invention, however, even the hair iron with flatter corrugated surfaces which have the wave width of 1/20 of the wave length can applied sufficient pressure to hair.

Figure 3:
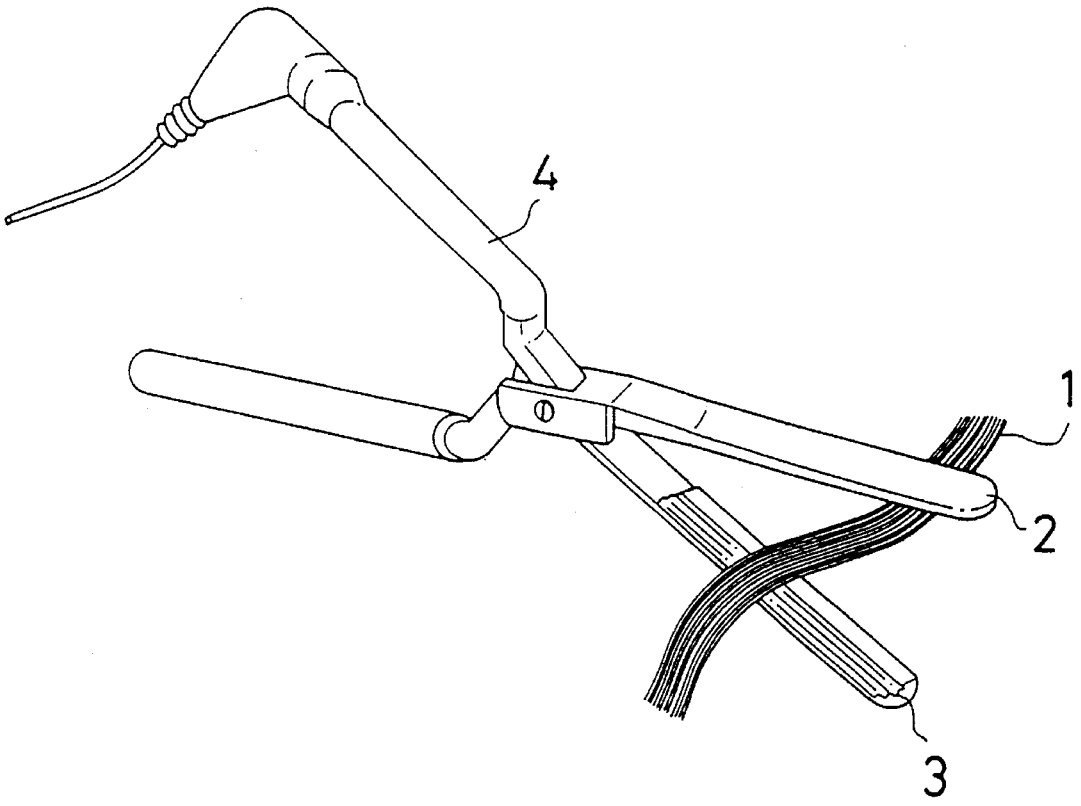
FIG. 3 is an overall perspective view of a hair iron in a second embodiment of the present invention.
Figure 4:
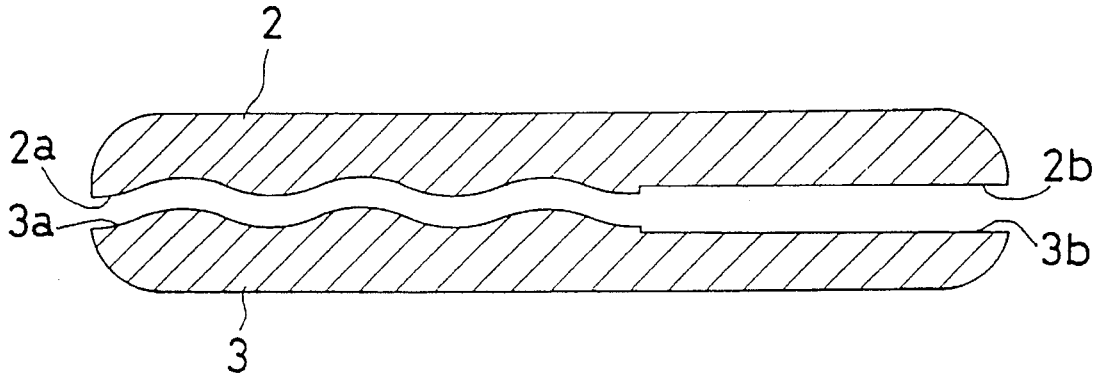
FIG. 4 is a partly magnified sectional view of the pressing members of the hair iron in FIG. 3.

A second embodiment of the invention is shown in FIGS. 3 and 4. In this embodiment, the opposing faces of the pressing members 2, 3 have corrugated portions 2*a*, 3*a* and other portions 2*b*, 3*b*. The former match each other, and the latter do not and have a gap when the iron is closed. Furthermore, in the use of the iron, the former are located at the root side of the hair and the latter at the tip side of the hair. Therefore, since the treatment described above is given from the root to the tip of hair, part of the hair is firstly warmed by the gap portions 2*b*, 3*b* and then pressed by the corrugated matching portions 2*a*, 3*a*.

The gap (the distance between the gap faces 2*b* and 3*b*) when the iron is closed is required to be large enough not to prevent hair from expanding when the hair is warmed in the gap. The size of the gap may set according to the quality of hair, but preferably about 0.4 mm.

In order to facilitate the work of shifting the iron on hair from the root to the tip, the width of the gap face portions 2*b*, 3*b* is desirably about 1/3 of the width of the pressing member portions 2, 3.

The method of straight-perming frizzled hair with the hair iron of the second embodiment is same as described in the first embodiment. Hair has the property of swelling and being soft when it is warmed. Therefore, in the use of the iron of the second embodiment, hair is warmed in the gap between the gap faces 2*b*, 3*b* of the pressing members 2, 3 and then becomes soft before it is pressed by the corrugated faces 2*a*, 3*a*, so that, when being pressed, it is more likely to be deformed according to the corrugation of the faces 2*a*, 3*a*. This lessens the number of times of pressing hair in order to straight it. In case of perming the hair of the similar quality, the ratio of the width with respect to the length of the wave of corrugation of the second embodiment is desirable to be smaller than that of the first embodiment.

In the first and second embodiments of the present invention, the uneven faces 2*a*, 3*a* of the pressing members 2, 3 are formed into a wave shape, but as long as the portions pressing hair are round, not angled, the shape is not limited thereto. Besides, in the second embodiment, the gap faces 2*b*, 3*b* are both flat, but they are not particularly limited to flat as far as there is a sufficient free space between the gap faces 2*b*, 3*b*.

The method of straight-perming frizzled hair is described above, but non-frizzled hair or straight hair may be similarly permed. The method gives such hair glossiness and smoothness. Since hair is permed by pressing, the volume is suppressed, and splitting of hair is prevented.

The hair iron of the present invention is thus composed, and a relatively large pressing force is applied to hair being treated in multiple directions by the corrugation of the pressing members. Shifting the iron on hair little by little from the root to the tip and repeatedly pressing the hair causes the hair to be pressed vertically and laterally in multiple directions, so that the hair is deformed to have a fine waveform without bending largely. Afterward the iron is slid on the hair from the root to the tip to stretch the hair and at the last step treatment with perming lotion (second solution) is given to the hair, and then the hair becomes straight. Even frizzled hair which is curly, less glossy, rough, damaged (or looks damaged), and/or not combed smoothly may become smooth, glossy and straight without being damaged through the treatment with the hair iron of the present invention. Thus treated hair does not return to the original frizzled hair by shampooing or dyeing, and for a long period the hair remains straight and keeps its smoothness and glossiness. Besides, thus pressingly treated hair does not split even if it is permed similarly many times.

What is claimed is:

1. A hair iron for straight-perming hair with heat and perming solution of a type having a grip part and pressing members, at least one of said pressing members being designed to be heated up for pressing hair, said pressing members, between which hair is clasped and pressed, comprising uneven opposing faces matching each other provided on the relative opposing faces of the pressing members, a section thereof being a waveform wherein a width of one wave of the waveform is one-fifth to one-thirtieth of a length of one wave.

2. A method of straight-perming hair with heat and perming solution using the hair iron of claim 1, wherein the method steps comprise clasping and pressing hair between the pressing members, shifting the hair iron along the hair little by little from the root to the tip thereof while repeatedly pressing and releasing the hair to deform the hair into a fine waveform by bending the hair in multiple directions, and, in a separate operation, sliding the hair iron on the hair frictionally from the root to the tip thereof to stretch the hair, and also treating the hair by applying a perming solution to the hair so as to make the hair straight.

* * * * *